US007791621B2

(12) United States Patent
Lin

(10) Patent No.: US 7,791,621 B2
(45) Date of Patent: Sep. 7, 2010

(54) SYSTEMS AND METHODS FOR PROVIDING DRIVING VOLTAGES TO RGBW DISPLAY PANELS

(75) Inventor: Ching-Wei Lin, Taoyuan (TW)

(73) Assignee: Toppoly Optoelectronics Corp., Chu-Nan, Miao-Li County (TW)

( * ) Notice: Subject to any disclaimer, the term of this patent is extended or adjusted under 35 U.S.C. 154(b) by 1031 days.

(21) Appl. No.: 11/379,067

(22) Filed: Apr. 18, 2006

(65) Prior Publication Data

US 2007/0242006 A1 Oct. 18, 2007

(51) Int. Cl.
*G09G 5/10* (2006.01)

(52) U.S. Cl. ..... 345/690; 345/89

(58) Field of Classification Search ..... 345/77, 345/83, 88, 89, 690
See application file for complete search history.

(56) References Cited

U.S. PATENT DOCUMENTS

| | | | | |
|---|---|---|---|---|
| 5,414,443 | A * | 5/1995 | Kanatani et al. | 345/95 |
| 6,593,934 | B1 | 7/2003 | Liaw et al. | |
| 6,885,380 | B1 | 4/2005 | Primerano et al. | |
| 6,897,876 | B2 | 5/2005 | Murdoch et al. | |
| 7,277,075 | B1 * | 10/2007 | Hirano et al. | 345/89 |
| 2004/0113875 | A1 | 6/2004 | Miller et al. | |

FOREIGN PATENT DOCUMENTS

| | | |
|---|---|---|
| EP | 0547603 | 6/1993 |
| EP | 1298637 | 2/2003 |
| WO | 0137249 | 5/2001 |

OTHER PUBLICATIONS

"AMOLED with RGB adjustable Gamma Compensation LTPS TFT Circuit" Matsueda et al., 2005.
CN Office Action mailed Sep. 4, 2009.

* cited by examiner

*Primary Examiner*—Alexander Eisen
*Assistant Examiner*—Robin Mishler
(74) *Attorney, Agent, or Firm*—Thomas, Kayden, Horstemeyer & Risley

(57) ABSTRACT

Systems and methods providing driving voltages to an RGBW display panel. A representative system comprises a data driver with a reference voltage generation circuit that is operative to provide reference voltages according to a white component signal (W) extracted from three color input signals (R,G,B), and a digital-to-analog (D/A) conversion unit that is operative to generate driving voltages according to the reference voltages, the three color input signals and the white component signal.

23 Claims, 16 Drawing Sheets

SYSTEMS AND METHODS FOR PROVIDING DRIVING VOLTAGES TO RGBW DISPLAY PANELS

BACKGROUND

The invention relates to panel displays, and more particularly, to systems and methods for providing driving voltages to RGBW display panels.

Color image display devices are well known and are based upon a variety of technologies such as cathode ray tubes, liquid crystal modulators and solid-state light emitters such as Organic Light Emitting Diodes (OLEDs). In a common OLED color image display device, a pixel includes red, green and blue colored subpixels. These light emitting colored subpixels define a color gamut, and by additively combining the illumination from each of these three subpixels, i.e. with the integrative capabilities of the human visual system, a wide variety of colors can be achieved. OLEDs may be used to generate color directly using organic materials to emit energy in desired portions of the electromagnetic spectrum, or alternatively, broadband emitting (apparently white) OLEDs may be attenuated with color filters to achieve red, green and blue output.

Images and data displayed on a color display device are typically stored and/or transmitted in three channels, that is, having these signals corresponding to a standard (e.g. RGB). It is also important to recognize that data typically is sampled to assume a particular spatial arrangement of light emitting elements. In an OLED display device, these light emitting elements are typically arranged side by side on a plane. Therefore, if incoming data is sampled for display on a color display device, the data will also be resampled for display on an OLED display having four subpixels per pixel rather than the three subpixels used in a three channel display device.

In this regard, FIG. 1A shows a conventional OLED subpixel driving circuit structure, and FIG. 1B shows RGBW subpixel arrangements of a conventional display panel. As shown in FIG. 1A, the subpixel is driven by the current I1 through the driving transistor T1. The driving transistor T1 outputs the current I1 according to the voltage V1.

FIG. 1C shows a conventional digital signal processing (DSP) structure for driving RGBW subpixels. As shown in FIG. 1C, RGB digital signals are sampled and held and output to a Gamma linear control unit. The Gamma linear control unit adjusts RGB digital signals for Gamma linearity and outputs to the conversion unit. The conversion unit converts the adjusted RGB digital signals to RGBW digital signals and outputs to a Gamma compensation unit. The Gamma compensation unit executes a Gamma compensation of the RGBW digital signals from the conversion unit for Gamma correction and outputs to a RGBW driver. The RGBW driver converts the RGBW digital signals to RGBW analog signals to drive corresponding RGBW subpixels.

FIG. 2A shows the relationship between the luminance of the OLED subpixel and the current I1. As shown, there is a linear relationship between the luminance of the OLED subpixel and the current I1. FIG. 2B shows the relationship between the current I1 of the driving transistor T1 and the voltage V1 to be non-linear. FIG. 2C shows the relationship between luminance of the OLED subpixel and observable brightness (gamma). FIG. 2D shows the relationship between observable brightness and voltage V1 applied to the driving transistor T1.

Thus, a gamma correction is required to compensate the non-linear relationship.

Conventionally, RGB data is converted to RGBW data through digital data processing (DSP). However, due to different optical characteristics (gamma correction) for each RGBW color, DSP typically requires a complicated algorithm to execute such conversion. Further, it may be difficult to obtain a precise analog output corresponding to the gamma correction for each color after using the complicated conversion algorithm.

For example, FIG. 3 shows a conventional method for converting RGB data to RGBW data. As shown in FIG. 3, the Min(R,G,B) is assumed to be W data, and R'G'B' data (driving the display device) can be obtained by removing the W component from the R,G,B components respectively. FIG. 4 shows another conventional method for converting RGB data to RGBW data. As shown in FIG. 4, the Min(R,G,B) is assumed to be W data, and the W component is converted to W' data in accordance with a characteristic of $\alpha$*W, where $\alpha<1$. The R'G'B' data are obtained by removing the W' component from the RGB components respectively. However, these two simple methods typically cannot precisely provide gamma correction for each color because of the non-linear relationship between driving voltage and observable brightness.

SUMMARY

Systems and method for providing driving voltages of RGBW display panels are disclosed. An exemplary embodiment of such a system comprises a data driver with a reference voltage generation circuit providing reference voltages according to a white component signal (W) extracted from three color input signals (R,G,B), and a digital-to-analog (D/A) conversion unit to generate driving voltages according to the reference voltages, the three color input signals and the white component signal.

An exemplary embodiment of a method for providing driving voltages of a RGBW display panel, comprises generating reference voltages according to a white component signal (W) extracted from three color input signals (R,G,B); and generating driving voltages according to the reference voltages, the three color input signals and the white component signal.

DESCRIPTION OF THE DRAWINGS

The invention can be more fully understood by the subsequent detailed description and examples with reference made to the accompanying drawings, wherein.

DETAILED DESCRIPTION

Figure 1A:
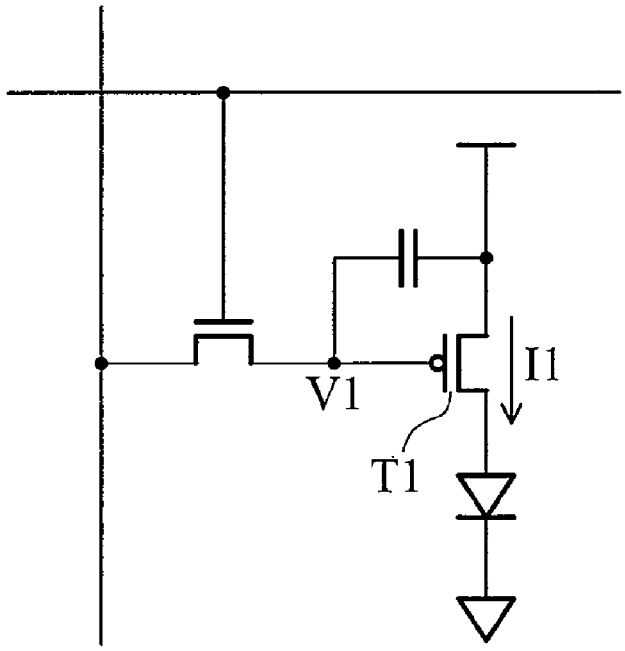
FIG. 1A ( RELATED ART )
FIG. 1A shows a conventional OLED subpixel driving circuit structure.
Figure 1B:
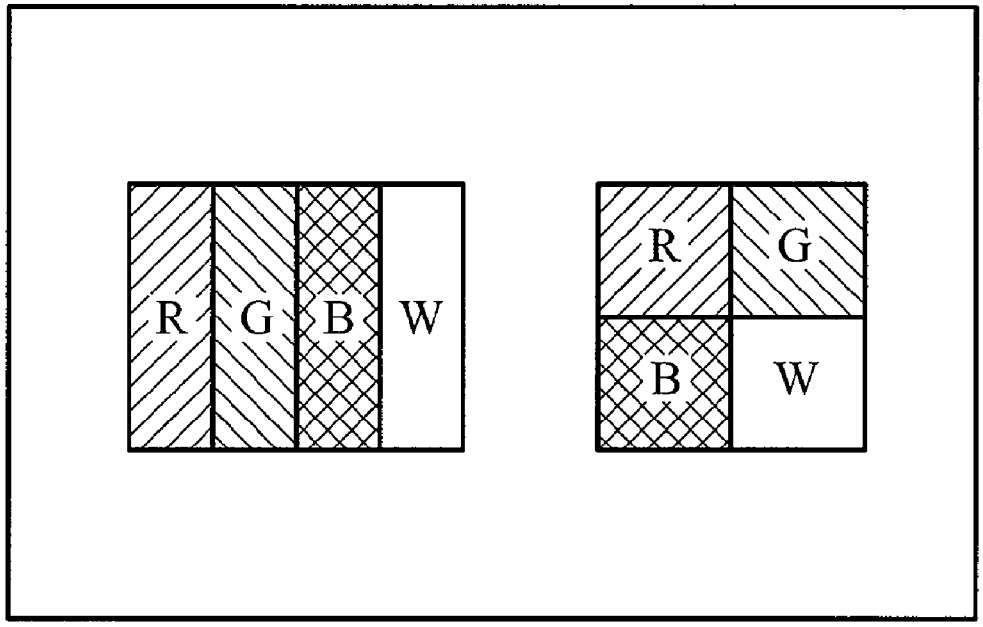
FIG. 1B ( RELATED ART )
FIG. 1B shows RGBW pixel arrangements of conventional display panel.
Figure 1C:
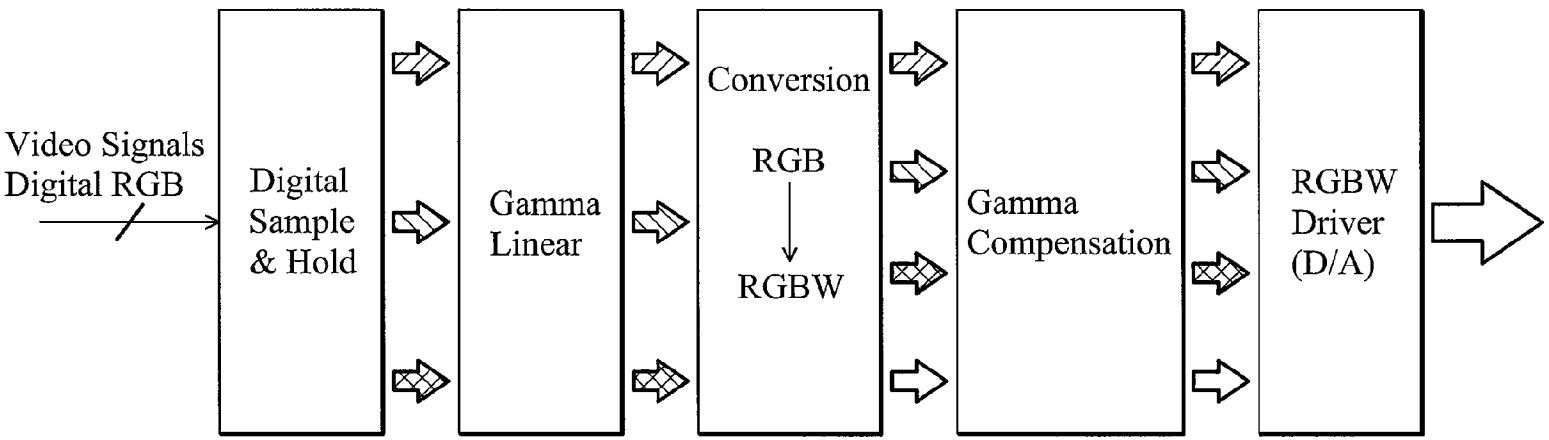
FIG. 1C ( RELATED ART )
FIG. 1C shows a conventional digital signal processing (DSP) structure for driving RGBW pixels.
Figure 2A:
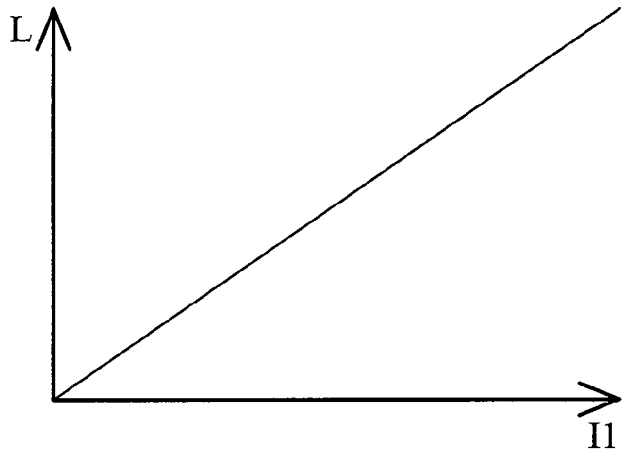
FIG. 2A ( RELATED ART )
FIG. 2A shows the relationship between the luminance of OLED and current.
Figure 2B:
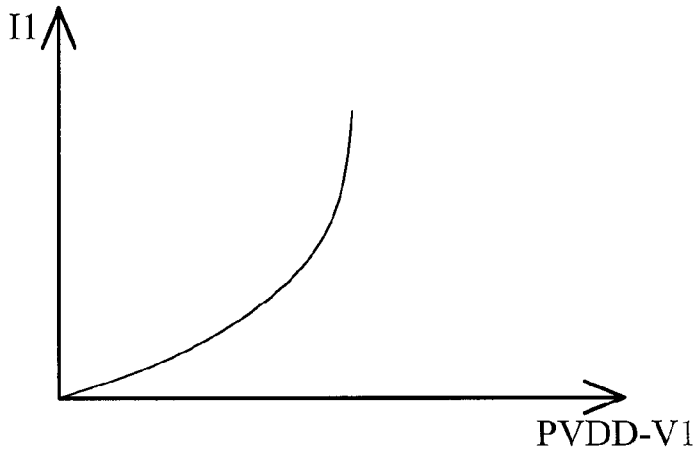
FIG. 2B ( RELATED ART )
FIG. 2B shows the relationship between current through the control transistor and driving voltage thereof.
Figure 2C:
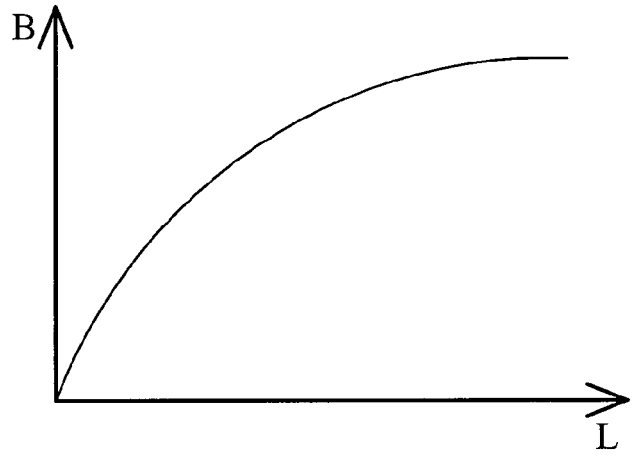
FIG. 2C ( RELATED ART )
FIG. 2C shows the relationship between luminance of the OLED and observable brightness.
Figure 2D:
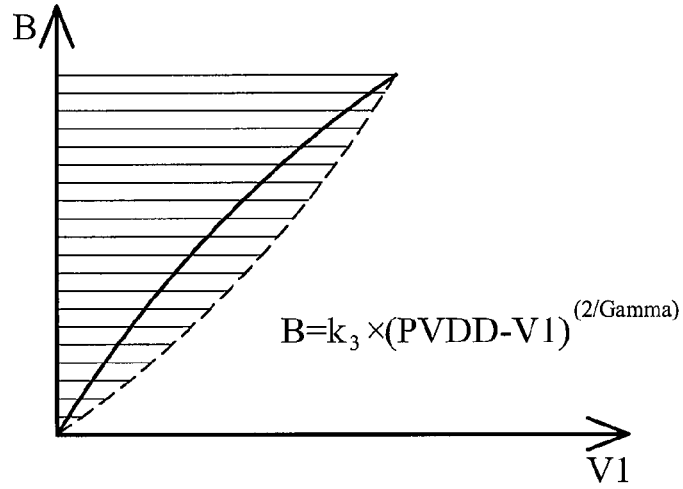
FIG. 2D ( RELATED ART )
FIG. 2D shows the relationship between observable brightness and driving voltage of driving transistor.
Figure 3:
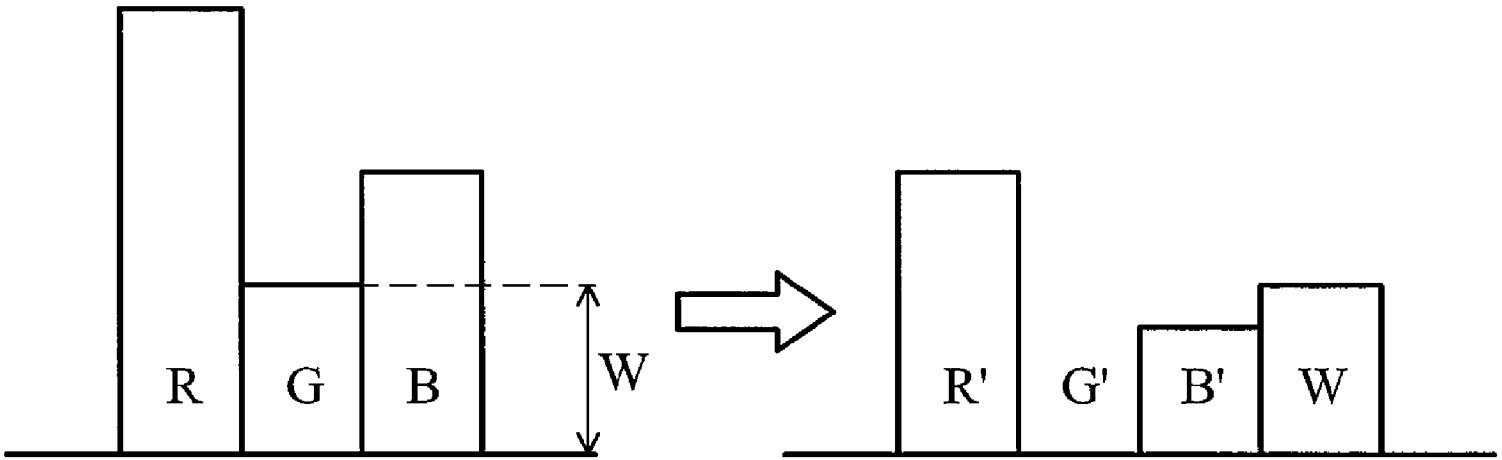
FIG. 3 ( RELATED ART )
FIG. 3 shows a conventional method for converting RGB data to RGBW data.
Figure 4:
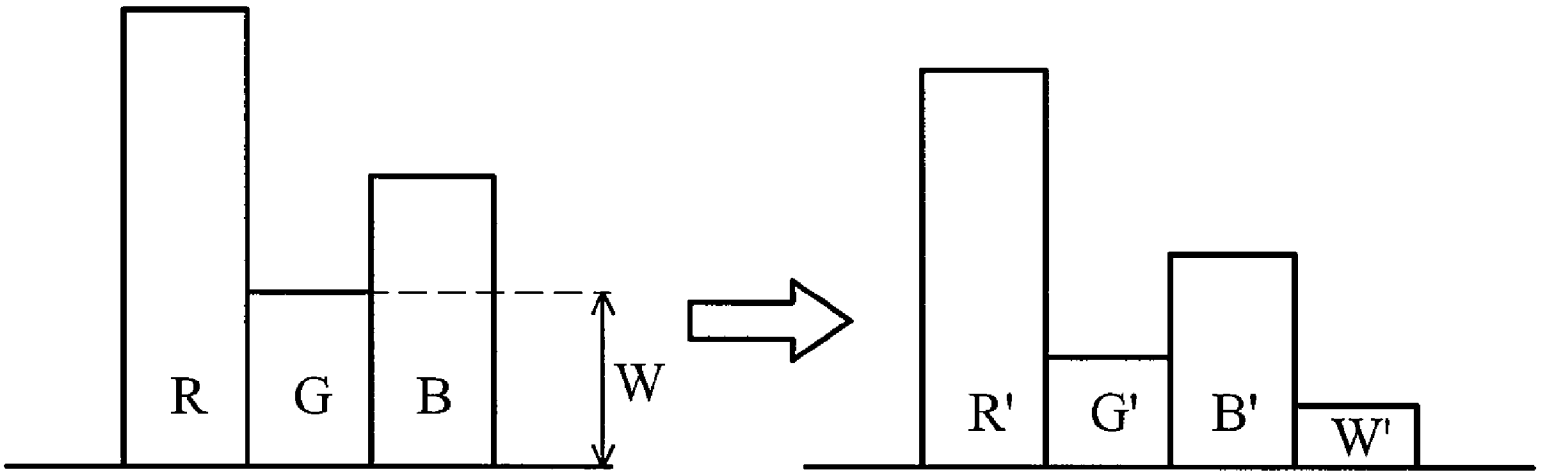
FIG. 4 ( RELATED ART )
FIG. 4 shows another conventional method for converting RGB data to RGBW data.
Figure 5:
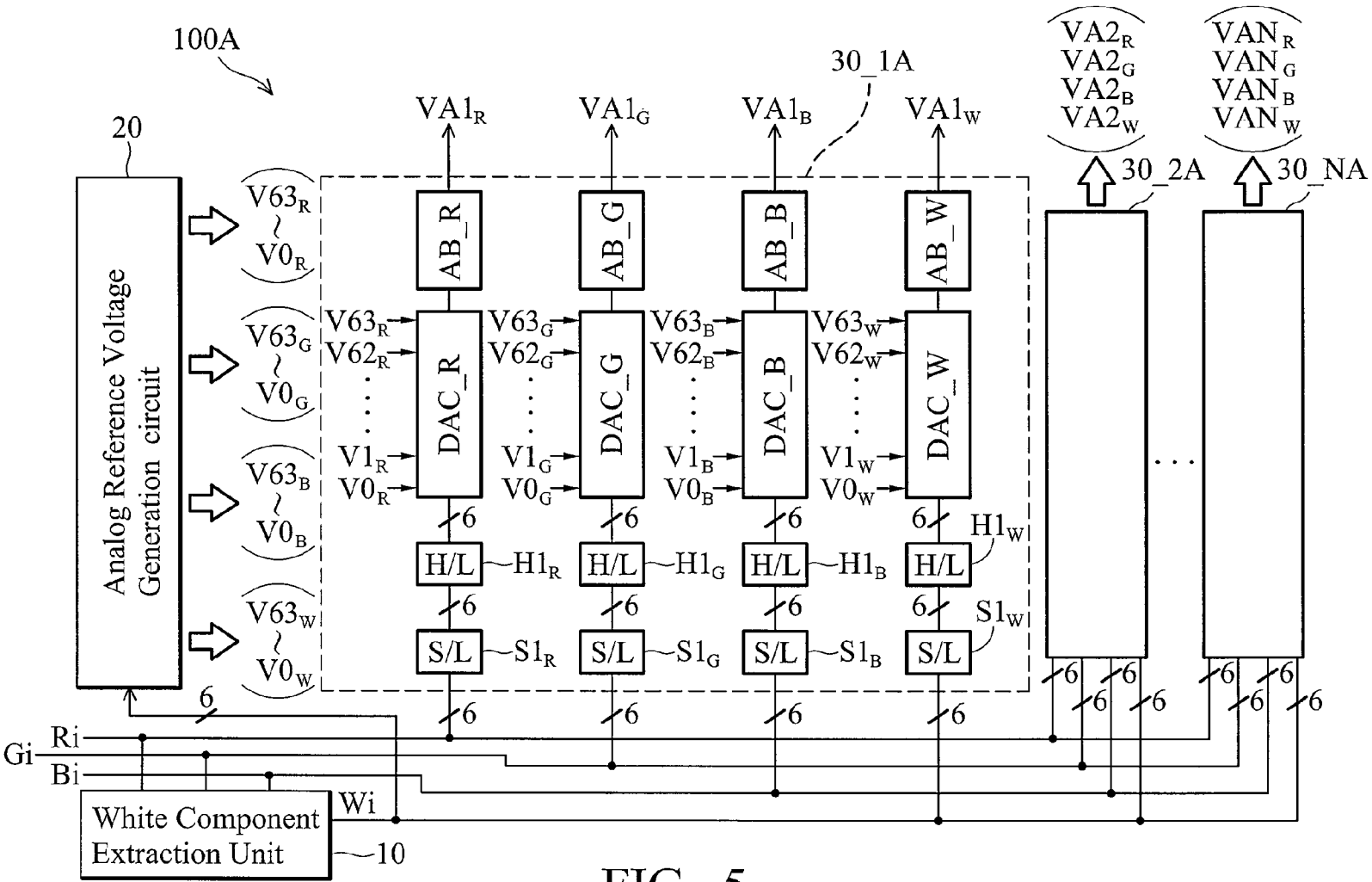
FIG. 5 shows an embodiment of a data driver.

Systems for providing driving voltages to display panels will now be described with reference to several exemplary embodiments. In this regard, an embodiment of a system providing driving voltages to an RGBW display panel is depicted in FIG. 5. As shown in FIG. 5, data driver 100A comprises a white component extraction unit 10, an analog reference voltage generation circuit 20 and N digital-to-analog (D/A) conversion units 30_1A~30_NA.

The white component extraction unit 10 extracts a white component signal Wi from three color input signals Ri, Gi and Bi. For example, three color input signals Ri, Gi and Bi can be 6 bit digital data, and the white component extraction unit 10 can be a minimum value detector. If color input signals R1, G1 and B1 are 110111, 010111 and 000111 respectively, the white component signal W1 can be 000111. Alternately, white component extraction unit 10 can output a suppressed white component signal W1 of 000011 according to the color input signal R1, G1 and B1.

Alternately, the white component signal Wi can be obtained by executing an AND logic operation to the three color input signals Ri, Gi and Bi. For example, when the color input signals R1, G1 and B1 are 110111, 010111 and 000111 respectively, the white component signal W1 can be 000111.

Conversely, the white component signal Wi can be obtained by executing an AND logic operation to M bits of the three color input signals Ri, Gi, Bi, and 0<M<6. For example, when M=2, a suppressed white component signal W1 of 000011 can be obtained according to the color input signal R1, G1 and B1.

The analog reference voltage generation circuit 20 generates four sets of reference voltages $V0_R$~$V63_R$, $V0_G$~$V63_G$, $V0_B$~$V63_B$ and $V0_W$~$V63_W$ for color input signal Ri, Gi and Bi and the white component signal Wi respectively, the reference voltages $V0_R$~$V63_R$, $V0_G$~$V63_G$ and $V0_B$~$V63_B$ are generated according to the white component signal Wi.

The D/A conversion units 30_1A~30_NA receive the reference voltages $V0_R$~$V63_R$, $V0_G$~$V63_G$, $V0_B$~$V63_B$ and $V0_W$~$V63_W$ from the analog reference voltage generation circuit 20 to generate corresponding driving voltages $VA1_R$~$VAN_R$, $VA1_G$~$VAN_G$, $VA1_B$~$VAN_B$ and $VA1_W$~$VAN_W$ according to the three color input signals Ri, Gi and Bi and the white component signal Wi. For example, the D/A conversion unit 30_1A receives the reference voltages $V0_R$~$V63_R$, $V0_G$~$V63_G$, $V0_B$~$V63_B$ and $V0_W$~$V63_W$ and generates corresponding driving voltages $VA1_R$, $VA1_G$, $VA1_B$ and $VA1_W$ according to the three color input signals R1, G1 and B1 and the white component signal W1 during a first period. The D/A conversion unit 30_2A receives the reference voltages $V0_R$~$V63_R$, $V0_G$~$V63_G$, $V0_B$~$V63_B$ and $V0_W$~$V63_W$ and generates corresponding driving voltages $VA2_R$, $VA2_G$, $VA2_B$ and $VA2_W$ according to the three color input signals R2, G2 and B2 and the white component signal W2 during a second period, and so on. Namely, all D/A conversion units 30_1A~30_NA employ the same type of analog reference voltage circuit which can generate different reference voltages $V0_R$~$V63_R$, $V0_G$~$V63_G$, $V0_B$~$V63_B$ and $V0_W$~$V63_W$ according to different white component signals Wi during different periods.

The D/A conversion units 30_1A~30_NA each comprise four sampling latches $S1_R$~$S1_W$, four holding latches $H1_R$~$H1_W$, four D/A converters DAC_R~DAC_W and four analog buffers AB_R~AB_W. The sampling latches $S1_R$~$S1_W$ sample the color input signals Ri, Gi and Bi and the white component signal Wi at one time. The holding latches $H1_R$~$H1_W$ hold the color input signals Ri, Gi and Bi and the white component signal Wi sampled by the sampling latches $S1_R$~$S1_W$. The D/A converters DAC_R~DAC_W convert the held color input signals Ri, Gi and Bi and the held white component signal Wi to corresponding analog voltages $VA1_R$~$VA1_W$ according to the reference voltages $V0_R$~$V63_R$, $V0_G$~$V63_G$, $V0_B$~$V63_B$ and $V0_W$~$V63_W$, and output the corresponding driving voltages $VA1_R$~$VA1_W$ through the analog buffers AB_R~AB_W. Operation and structure of the D/A conversion units 30_2A~30_NA are similar to those of the D/A conversion unit 30_1A. In this embodiment, the data diver 100A can output four corresponding voltages to drive four data lines at one time.

Figure 6A:
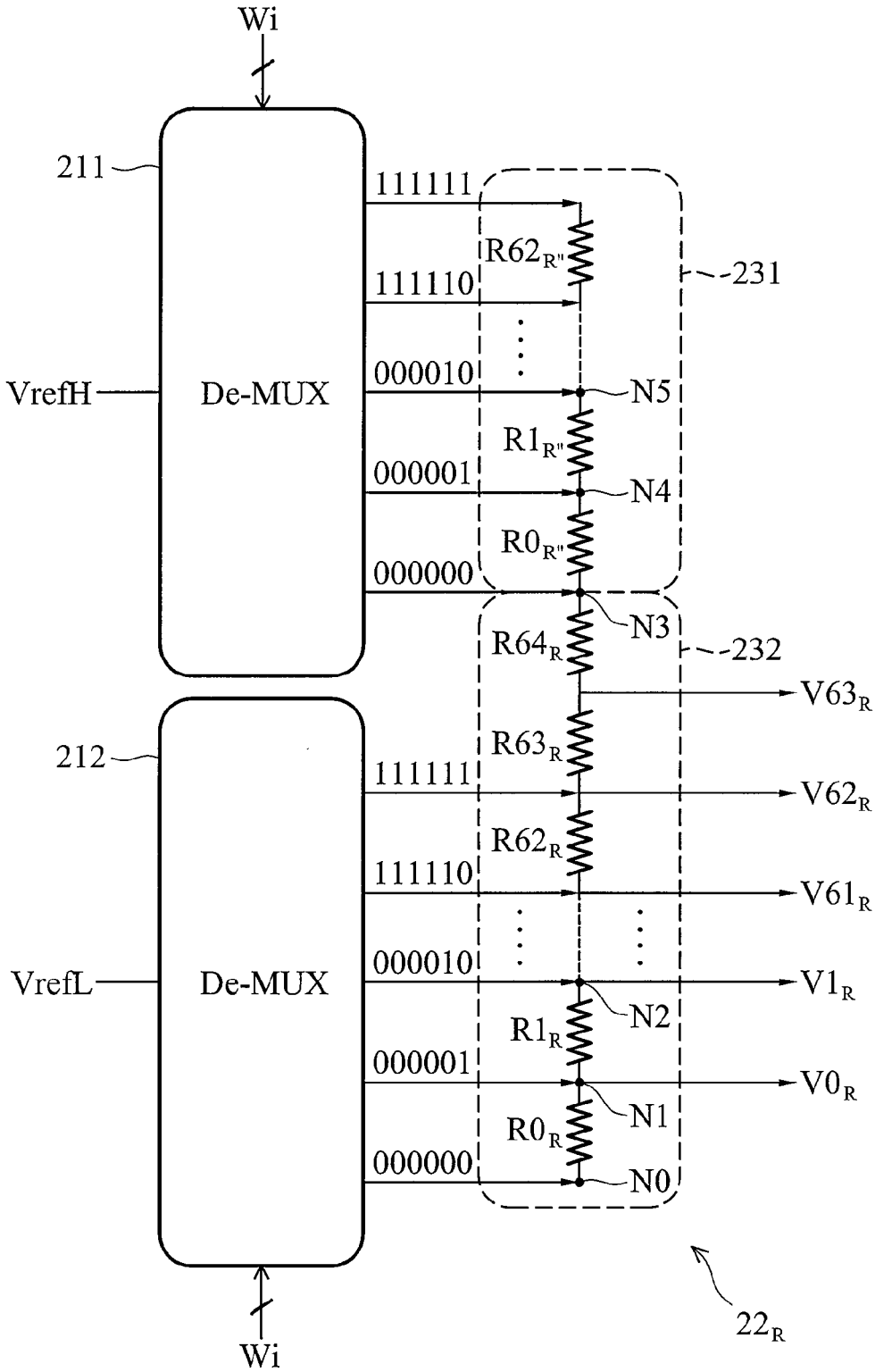
FIGS. 6A~6D show embodiments of a voltage generator.

The analog reference voltage generation circuit 20 comprises four voltage generators 22R, 22G, 22B and 22W shown in FIGS. 6A-6D to generate reference voltages $V0_R$~$V63_R$, $V0_G$~$V63_G$, $V0_B$~$V63_B$ and $V0_W$~$V63_W$. As shown in FIG. 6A, the voltage generator 22R generates the reference voltages $V0_R$~$V63_R$ to D/A converters DAC_R of the D/A conversion units 30_1A~30_NA according to the white component signal Wi. The voltage generator 22R comprises two de-multiplexers 211 and 212 and two series-connected resistor strings 231 and 232. The resistor string 231 comprises resistors $R0_{R''}$~$R62_{R''}$ connected in series, and the resistor string 232 comprises resistors $R0_R$~$R64_R$ for red color grey level gamma correction. The de-multiplexer 211 selectively outputs a first power voltage VerfH to one node of the resistor string 231 according to the white component signals Wi, and the de-multiplexer 212 selectively outputs a second power voltage VrefL to one node of the resistor string 232 according to the white component signals Wi. The first power voltage VrefH exceeds the second power voltage VrefL, the resistors $R0_{R''}$ and $R0_R$ are the same, the resistors $R1_{R''}$ and $R1_R$ are the same, the resistors $R2_{R''}$ and $R2_R$ are the same, and so on.

For example, if the white component signal Wi extracted from the three color input signals Ri, Gi and Bi is 000000, the power voltage VrefL is forced to the node N0 of the resistor string 232, and the power voltage VrefH is forced to the node N3 of the resistor string 231. Alternately, if the white component signal Wi extracted from the three color input signals Ri, Gi and Bi is 000001, the power voltage VrefL is forced to the node N1 of the resistor string 232, and the power voltage VrefH is forced to the node N4 of the resistor string 231. Accordingly, the voltage level of the reference voltage $V0_R$~$V63_R$ for the red input signal Ri can be lowered by a first voltage drop.

Alternately, if the white component signal Wi extracted from the three color input signals Ri, Gi and Bi is 000010, the power voltage VrefL is forced to the node N2 of the resistor string 232, and the power voltage VrefH is forced to the node N5 of the resistor string 231. Accordingly, the voltage level of the reference voltage $V0_R$~$V63_R$ for the red input signal Ri can be lowered by a second voltage drop exceeding the first voltage drop. Thus, the voltage level of the reference voltage $V0_R$~$V63_R$ for the red input signal Ri can be adjusted based on the white component signal Wi.

Figure 6B:
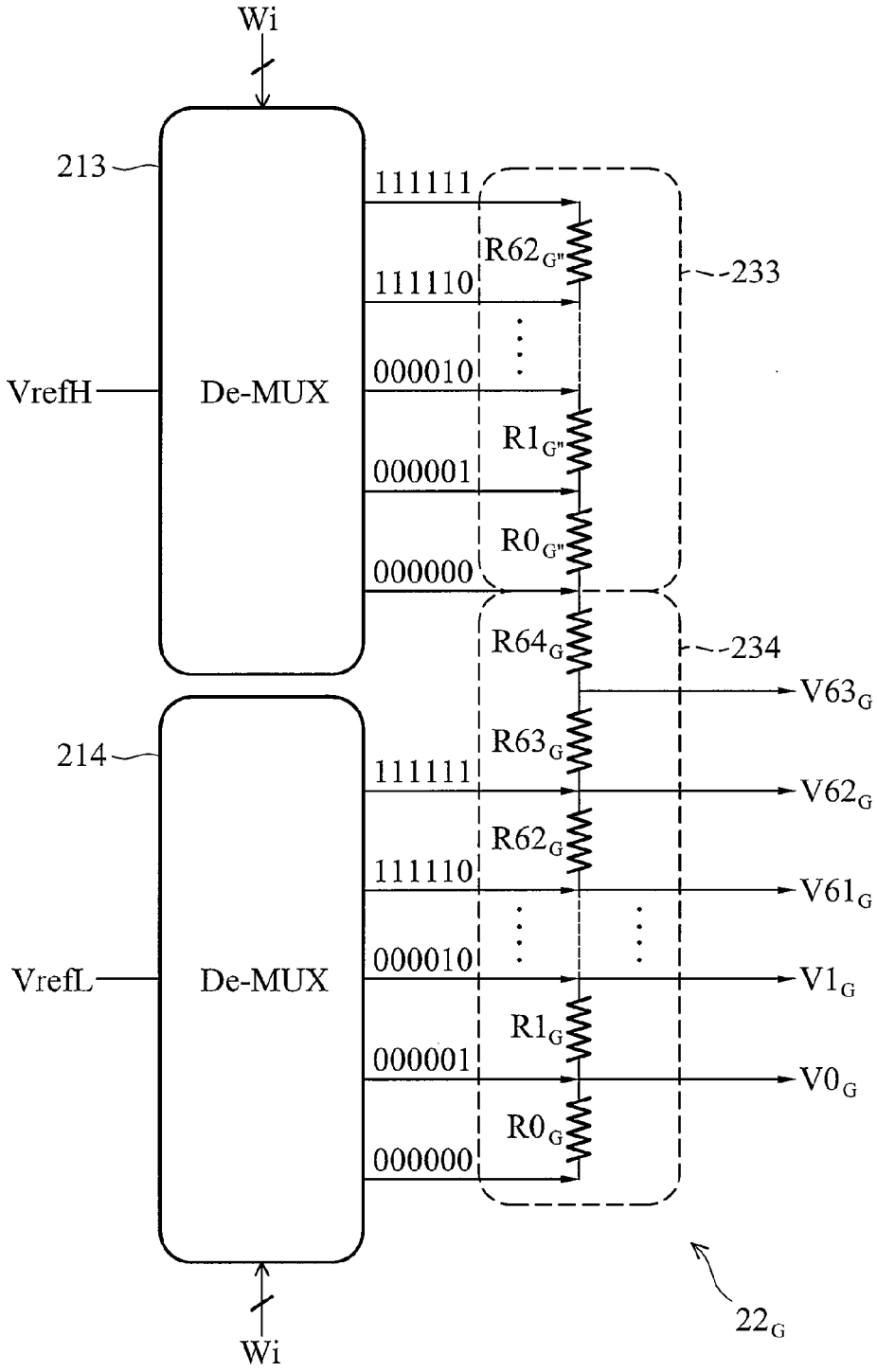

As shown in FIG. 6B, the voltage generator 22G generates the reference voltages $V0_G$~$V63_G$ to D/A converters DAC_G of the D/A conversion units 30_1A~30_NA according to the white component signal Wi. The voltage generator 22R comprises two de-multiplexers 213 and 214 and two series-connected resistor strings 233 and 234. The resistor string 233 comprises resistors $R0_{G''}$~$R62_{G''}$ connected in series, and the resistor string 234 comprises resistors $R0_G$~$R64_G$ for green color grey level gamma correction. The de-multiplexer 213 selectively outputs the first power voltage VrefH to one node of the resistor string 233, and the de-multiplexer 214 selectively outputs the second power voltage VrefL to one node of the resistor string 234. The resistors $R0_{G''}$ and $R0_G$ are the same, the resistors RIG and $R1_G$ are the same, the resistors $R2_{G''}$ and $R2_G$ are the same, and so on.

Figure 6C:
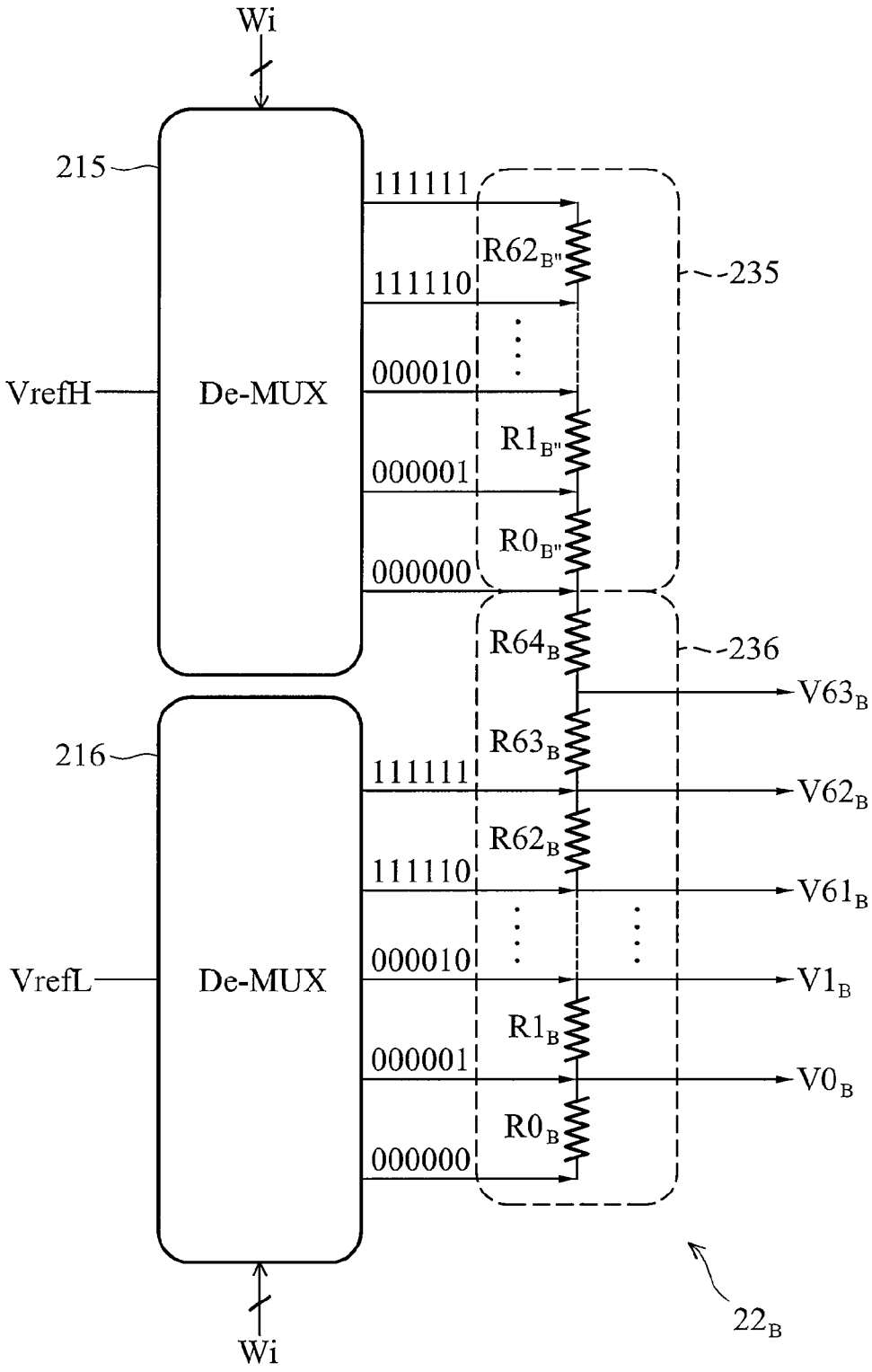

As shown in FIG. 6C, the voltage generator 22B generates the reference voltages $V0_B$~$V63_B$ to D/A converters DAC_B of the D/A conversion units 30_1A~30_NA according to the white component signal Wi. The voltage generator 22B comprises two de-multiplexers 215 and 216 and two series-connected resistor strings 235 and 236. The resistor string 235 comprises resistors $R0_{B''}$~$R62_{B''}$ connected in series, and the resistor string 236 comprises resistors $R0_B$~$R64_B$ for blue color grey level gamma correction. The de-multiplexer 215 selectively outputs the first power voltage VrefH to one node of the resistor string 235, and the de-multiplexer 216 selectively outputs the second power voltage VrefL to one node of the resistor string 236. The resistors $R0_{B''}$ and $R0_B$ are the same, the resistors $R1_{B''}$ and $R1_B$ are the same, the resistors $R2_{B''}$ and $R2_B$ are the same, and so on. Operation of the voltage generator 22G and 22B is similar to that of the voltage generator 22R. The resistors $R0_R$~$R64_R$, $R0_G$~$R64_G$ and $R0_B$~$R62_B$ can be different from others, depending on design.

Figure 6D:
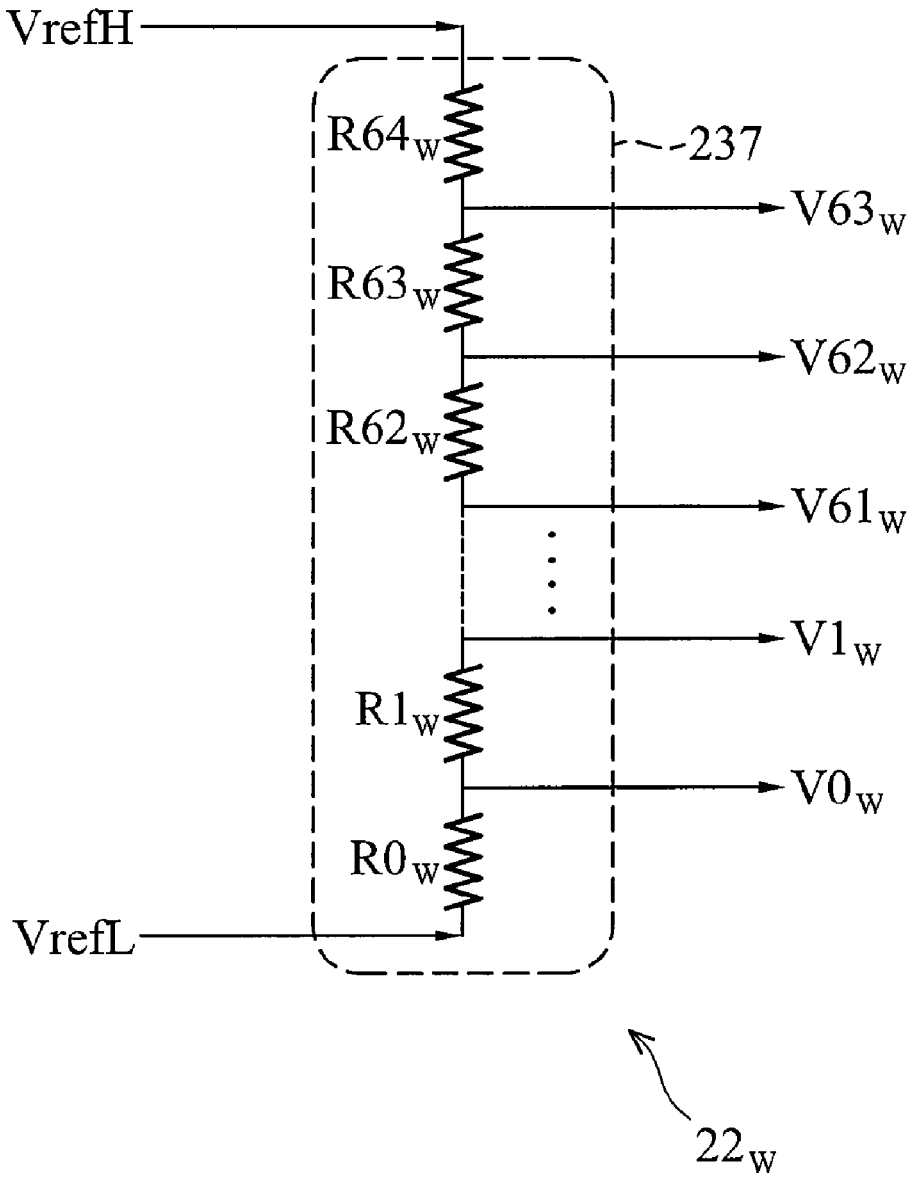

As shown in FIG. 6D, the voltage generator 22W comprises a resistor string 237 comprising a plurality of resistors $R0_W$~$R63_W$ connected in series for white color grey level gamma correction. The power voltages VrefH and VrefL are forced to two ends of the resistor string 237, such that the reference voltages $V0_W$~$V63_W$ are generated according to difference resistances of the resistors $R0_W$~$R63_W$.

In this embodiment, the voltage level of the reference voltages V0R~V63R, V0G~V63G and V0B~V63B for three color input signals Ri, Gi and Bi can be adjusted based on the white component signal Wi. The lower voltage level of the reference voltages $V0_R$~$V63_R$, $V0_G$~$V63_G$ and $V0_B$~$V63_B$, the lower driving voltage $VA1_R$~$VAN_R$, $VA1_G$~$VAN_G$ and $VA1_B$~$VAN_B$ generated by D/A conversion units 30_1A~30_NA. Namely, the voltage level of the driving voltages $VA1_R$~$VAN_R$, $VA1_G$~$VAN_G$ and $VA1_B$~$VAN_B$ generated by D/A conversion units 30_1A~30_NA can be adjusted according to the extracted white component signal Wi. When N-type transistors are used as driving devices of pixels, the RGB brightness of the subpixels on a display device is lowered as the driving voltage decreases based on the white component signal Wi. In some embodiments, when P-type transistors are used as driving devices of pixels, the RGB brightness of the pixels on a display device is lowered as the driving voltage increases based on the white component signal Wi. Thus, gamma correction for RGBW brightness can be accurately controlled.

Alternately, in some embodiments, the de-multiplexers 211, 213 and 215 selectively output the second power voltage VrefL to one node of the resistor string 231, 233 and 235, and the de-multiplexer 212, 214 and 216 selectively output the first power voltage VrefH to one node of the resistor string 232, 234 and 236.

Figure 7:
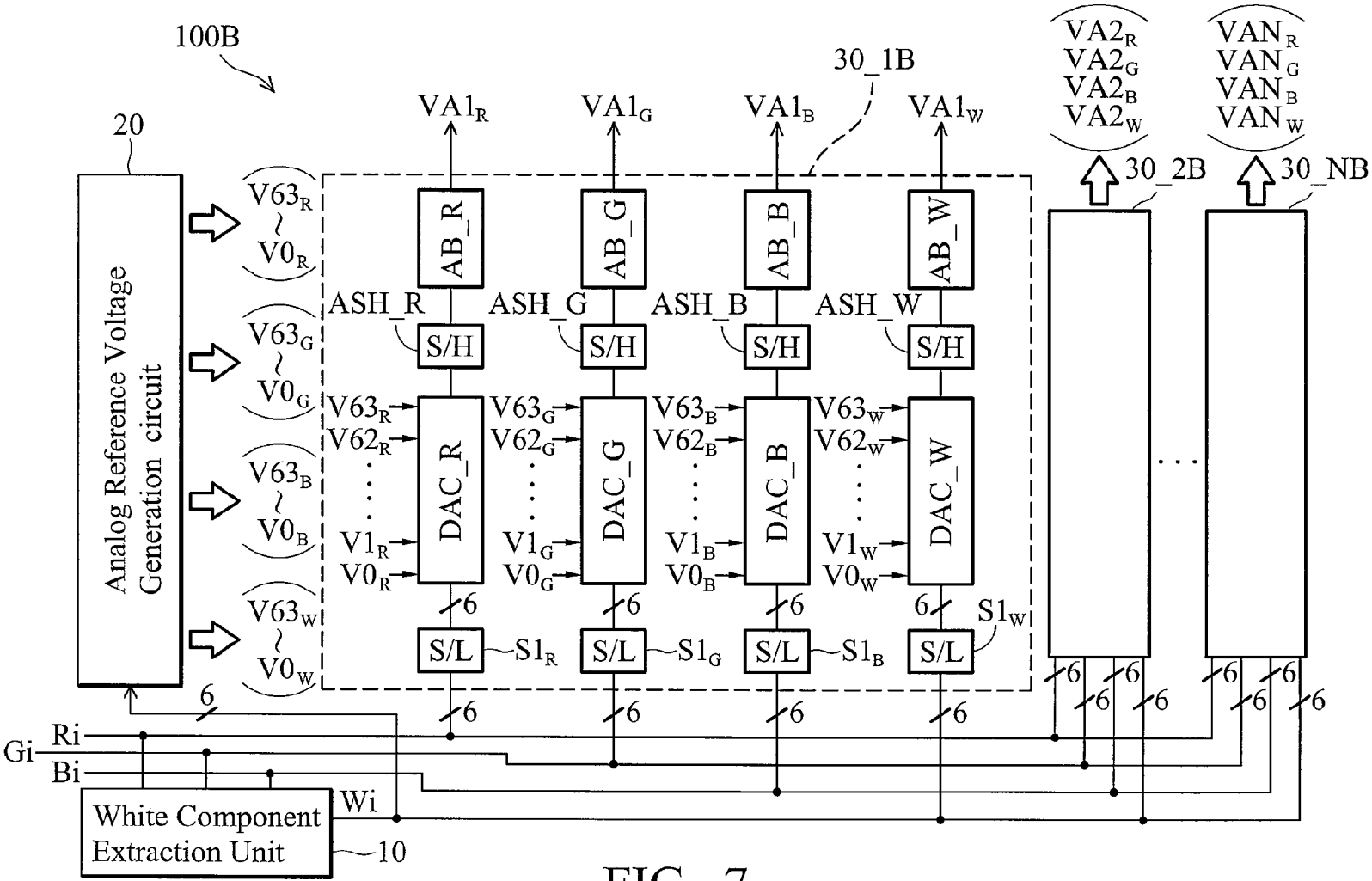
FIG. 7 shows another embodiment of a data driver.

FIG. 7 shows another embodiment of a data driver. As shown, the data driver 100B is similar to the data driver 100A shown in FIG. 5, with the exception of analog sampling and holding latches ASH_R~ASH_W coupled between the analog buffers AB_R~AB_W and the D/A converters DAC_R~DAC_W in each D/A conversion unit 30_1B~30_NB. Description of the same structure shown in FIG. 5 is omitted for simplification. In the data driver 100B, the driving voltages $VA1_R$~$VAN_R$, $VA1_G$~$VAN_G$, $VA1_B$~$VAN_B$ and $VA1_W$~$VAN_W$ generated by the D/A conversion units 30_1B~30_NB during different periods can be sampled and held by the analog sampling and holding latches ASH_R~ASH_W. Thus, the data driver 100B can output the corresponding voltages to drive one row of data lines in one time.

Figures 1, 8:
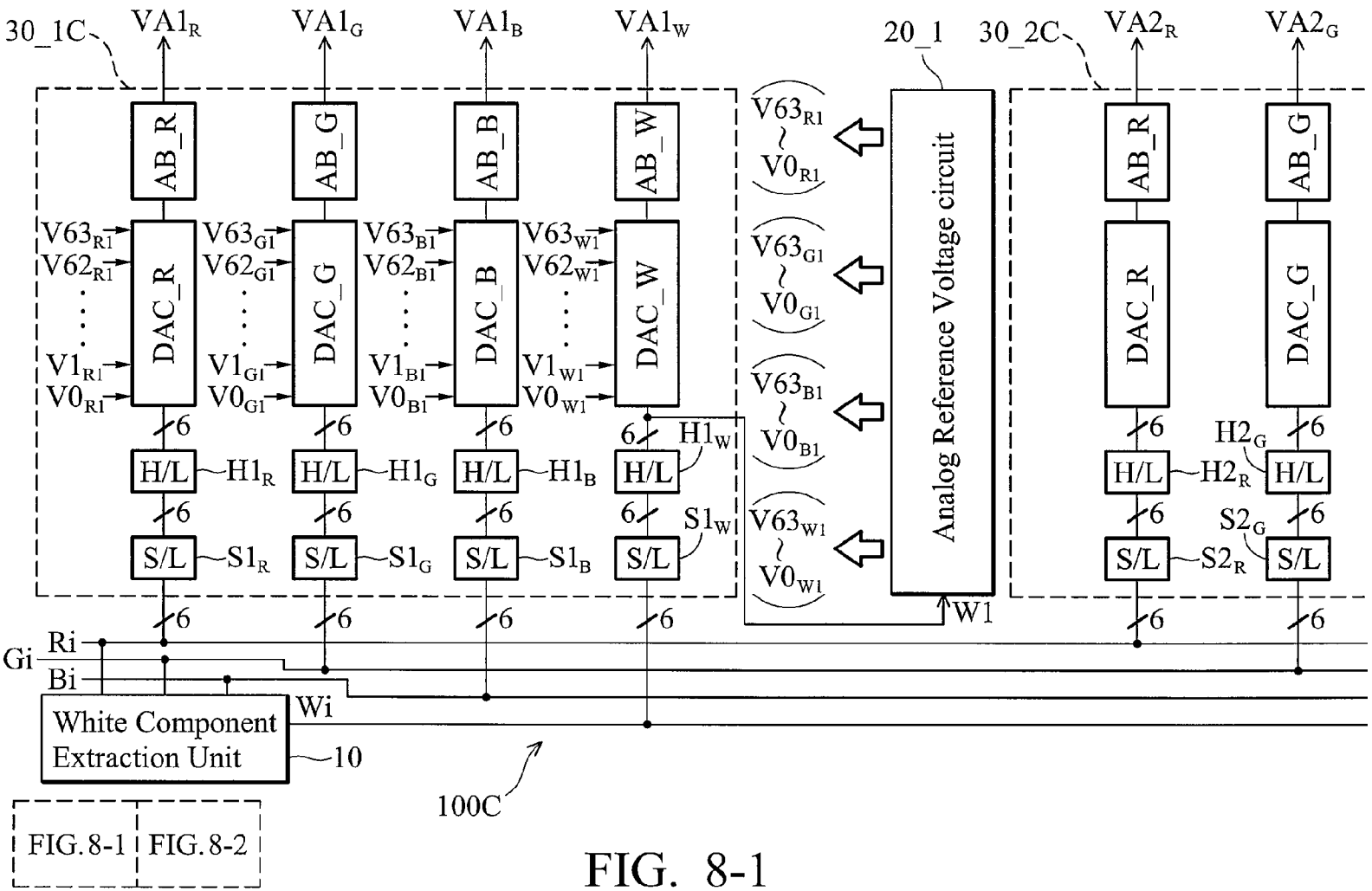
FIGS. 8-1 and 8-2 show another embodiment of a data driver.
Figures 2, 8:
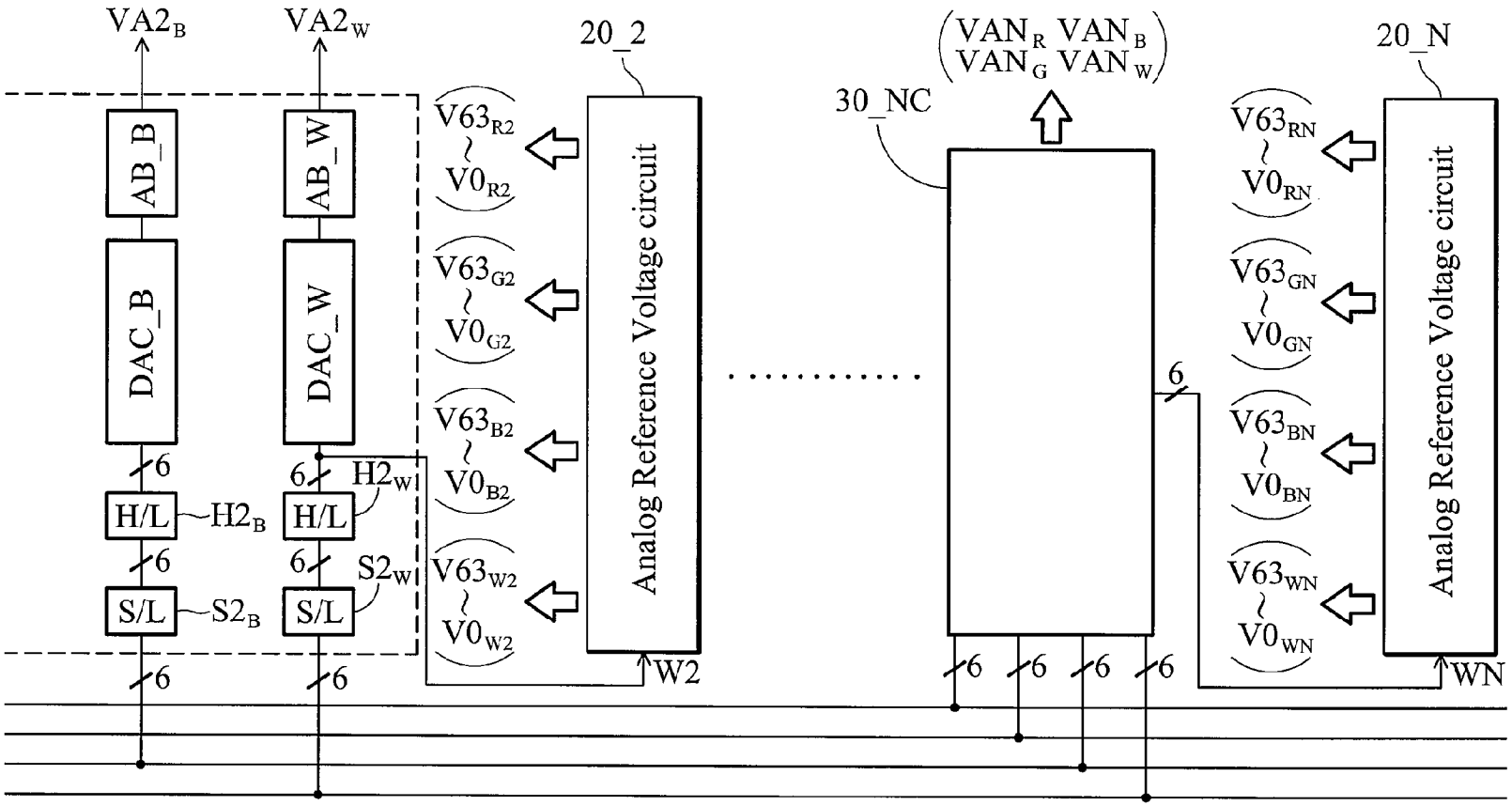

FIGS. 8-1 and 8-2 show another embodiment of a data driver. As shown, the data driver 100C is similar to the data driver 100A shown in FIG. 5, with the exception of N analog reference voltage generation circuits 20_1~20_N coupled to the D/A conversion units 30_1~30_NC. Description of the same structure shown in FIG. 7 is omitted for simplification. In the data driver 100C, the N analog reference voltage generation circuits 20_1~20_N each correspond to one of the D/A conversion units 30_1C~30_NC. For example, the analog reference voltage generation circuit 20_1 corresponds to the D/A conversion unit 30_1C, the analog reference voltage generation circuit 20_2 corresponds to the D/A conversion unit 30_2C, and so on. The color input signals Ri, Gi, Bi and the extracted white component signal Wi are sampled by the sampling latches $S1_R$~$S1_W$ and held by the holding latches $H1_R$~$H1_W$ in the D/A conversion units 30_1C~30_NC during each period. For example, the color input signals R1, G1, B1 and the extracted white component signal W1 are sampled and held in the D/A conversion units 30_1C during a first period, the color input signals R2, G2, B2 and the extracted white component signal W2 are sampled and held in the D/A conversion units 30_2C during a second period, and so on.

All held color input signals Ri, Gi, Bi and the white component signal Wi can be output to the corresponding D/A converters DAC_R~DAC_W and the corresponding analog reference voltage circuit at one time. For example, the white component signal W1 is output to analog reference voltage generation circuit 20_1, such that the reference voltages $V0_R$~$V63_R$, $V0_G$~$V63_G$, $V0_B$~$V63_B$ and $V0_W$~$V63_W$ are output to the D/A converters DAC_R~DAC_W. Accordingly, the D/A converters DAC_R~DAC_W receive the reference voltages $V0_R$~$V63_R$, $V0_G$~$V63_G$, $V0_B$~$V63_B$ and $V0_W$~$V63_W$ and generate the driving voltage $VA1_R$~$VA1_W$ according to the three color input signals R1, G1, B1 and W1. Similarly, the D/A conversion units 30_2C~30_NC generate the driving voltages $VA2_R$~$VAN_R$, $VA2_G$~$VAN_G$ and $VA2_B$~$VAN_B$ at the same time. Namely, the data driver 100C can output the corresponding voltages to drive one row of data lines in one time.

Figure 9:
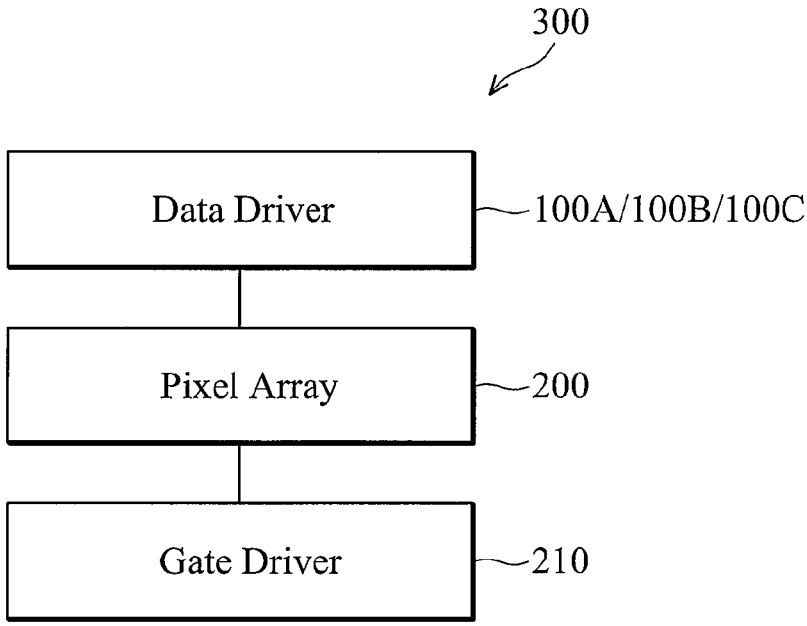
FIG. 9 is a schematic diagram of an embodiment of a display.

FIG. 9 is a schematic diagram of another embodiment of a system, in this case a display panel, for providing driving voltages. As shown in FIG. 9, the display device 300 comprises a data driver such as data driver 100A/100B/100C, a pixel array 200 and a gate driver 210. The pixel array 200 comprises RGBW color pixels arranged in matrix, a plurality of data lines and a plurality of scan lines. The data driver generates analog driving voltages to the pixel array 200, and the gate driver 210 provides scan signals to the pixel array 200 such that the scan lines are asserted or de-asserted. The pixel array 200 generates color images according to the analog driving voltages from the data driver. While the display panel can be an organic light emitting panel, an electroluminescent panel or a liquid crystal display panel for example, various other technologies can be used in other embodiments.

Figure 10:
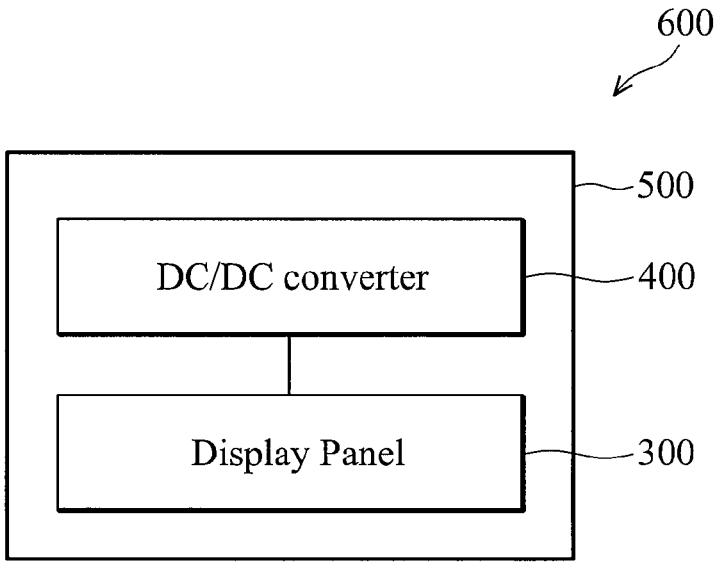
FIG. 10 is a schematic diagram of an embodiment of an electronic device employing the display panel shown in FIG. 9.

FIG. 10 schematically shows an embodiment of yet another system, in this case an electronic device for providing driving voltages. In particular, electronic device 600 employs a display panel such as display panel 600 shown in FIG. 9. The electronic device 600 may be a device such as a PDA, notebook computer, digital camera, tablet computer, cellular phone or a display monitor device, for example.

Generally, the electronic device 600 comprises a housing 500, a display panel 300 and a DC/DC converter 400, although it is to be understood that various other components can be included, such components not shown or described here for ease of illustration and description. In operation, the DC/DC converter 400 powers the display panel 300 so that the display panel 300 can display color images.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying image, comprising:

a data driver comprising:

a reference voltage generation circuit operative to generate reference voltages, according to a white component signal (W) extracted from three color input signals (R,G,B), for the three color input signals (R,G,B) and the white component signal (W), wherein the reference voltage generation circuit selectively forces first and second power voltages to two corresponding nodes of at least two resistor strings connected in series according to the white component signal (W) to generate the reference voltages; and a digital-to-analog (D/A) conversion unit operative to generate driving voltages according to the reference voltages, the three color input signals and the white component signal.

2. The system as claimed in claim 1, further comprising a white component extraction unit operative to extract the white component signal (W) from the three color input signals (R,G,B).

3. The system as claimed in claim 1, wherein the reference voltage generation circuit comprises first, second, third and fourth voltage generators, in which the first to third voltage generators are operative to generate the first to third sets of reference voltages according to the white component signal, and the fourth voltage generator is operative to generate the fourth set of reference voltage.

4. The system as claimed in claim 3, wherein the digital-to-analog conversion unit comprises first, second, third and fourth (D/A) converters operative to generate the driving voltages according to the first to fourth sets of reference voltages, the three color input signals and the white component signal.

5. The system as claimed in claim 4, wherein the digital-to-analog conversion unit further comprises a plurality of digital holding units coupled to the (D/A) converters and operative to hold the three color input signals and the white component signal.

6. The system as claimed in claim 4, wherein the digital-to-analog conversion unit further comprises a plurality of analog holding units operative to hold the driving voltages from the (D/A) converters.

7. The system as claimed in claim 1, further comprising a display panel comprising four color (R,G,B,W) pixels operative to generate color images according to the driving voltages.

8. The system as claimed in claim 3, wherein the first to third voltage generators each comprise:

first and second resistor strings connected in series, each comprising a plurality of resistors and nodes;

a first de-multiplexer coupled between the first resistor and the first power voltage; and a second de-multiplexer coupled between the second resistor string and the second power voltage, wherein, according to the white component signal, the first de-multiplexer selectively forces the first power voltage to one node of the first resistor string and the second de-multiplexer selectively forces the second power voltage to one node of the second resistor string, such that first to third sets of reference voltages are regulatable.

9. The system as claimed in claim 8, wherein the fourth voltage generator comprises a third resistor string coupled between the first power voltage and the second power voltage.

10. The system as claimed in claim 8, wherein the first and second resistor strings of the first, the second and the third voltage generators exhibit different resistances.

11. The system as claimed in claim 7, wherein the display panel is a liquid crystal display panel.

12. The system as claimed in claim 7, wherein the display panel is an electroluminescent panel.

13. The system as claimed in claim 7, wherein the display panel is an organic light emitting panel.

14. The system as claimed in claim 1, wherein the system is implemented as a PDA, a display monitor, a digital camera, a notebook computer, a tablet computer or a cellular phone.

15. A method for providing driving voltages of a system for displaying images, comprising:

forcing selectively first and second power voltages to two corresponding nodes of at least two resistor strings connected in series according to a white component signal (W) to generate reference voltages; and generating driving voltages according to the reference voltages, the three color input signals and the white component signal.

16. The method as claimed in claim 15, further comprising extracting the white component signal (W) from the three color input signals (R,G,B).

17. The method as claimed in claim 16, wherein the reference voltages comprise first, second and third sets of reference voltages corresponding to the three color input signals respectively according to the white component signal, and a fourth set of reference voltages corresponding to the white component signal.

18. The method as claimed in claim 17, wherein the driving voltage is generated according to the first to fourth sets of reference voltages, the three color input signals and the white component signal.

19. The method as claimed in claim 15, further comprising holding the white component signal (W) and the three color input signals (R,G,B) before generating the driving voltages.

20. The method as claimed in claim 16, wherein the white component signal (W) and the three color input signals (R,G,B) each is a digital data comprising N bits, and the white component signal (W) is obtained by executing an AND logic operation to the three color input signals (R,G,B).

21. The method as claimed in claim 16, wherein the white component signal (W) and the three color input signals (R,G,B) each is a digital data comprising N bits, and the white component signal (W) is obtained by executing an AND logic operation to M bits of the three color input signals (R,G,B), and $0<M<N$.

22. The method as claimed in claim 15, further comprising holding the generated driving voltage.

23. The method as claimed in claim 15, wherein the system comprises a display device and the display device is an organic light emitting device, a liquid crystal display device or an electroluminescent device.

* * * * *